United States Patent [19]

Genereux et al.

[11] Patent Number: 4,769,087

[45] Date of Patent: Sep. 6, 1988

[54] NICKEL BASE SUPERALLOY ARTICLES AND METHOD FOR MAKING

[75] Inventors: Paul D. Genereux, Cromwell; Daniel F. Paulonis, Higganum, both of Conn.

[73] Assignee: United Technologies Corporation, Hartford, Conn.

[21] Appl. No.: 869,506

[22] Filed: Jun. 2, 1986

[51] Int. Cl.[4] ..... C22F 1/10

[52] U.S. Cl. ..... 148/2; 148/11.5 N; 148/12.7 N; 148/410; 148/428

[58] Field of Search ..... 148/12.7 N, 11.5 N, 148/2, 409, 410, 426–429

[56] References Cited

U.S. PATENT DOCUMENTS

| | | | |
|---|---|---|---|
| 3,529,503 | 9/1970 | Sederberg et al. | 83/146 |
| 3,620,855 | 11/1971 | Wagner et al. | 148/32.5 |
| 3,649,379 | 3/1972 | Kotval | 148/12.7 |
| 3,676,225 | 7/1972 | Owczarski et al. | 148/12.7 |
| 3,677,830 | 7/1972 | Cox et al. | 148/12.7 |
| 3,802,938 | 4/1974 | Collins et al. | 148/126 |
| 3,975,219 | 8/1976 | Allen et al. | 148/11.5 |
| 4,081,295 | 3/1978 | Vogel | 148/11.5 |
| 4,110,131 | 8/1978 | Gessinger | 148/11.5 |
| 4,392,894 | 7/1983 | Pearson et al. | 148/2 |
| 4,574,015 | 3/1986 | Genereux et al. | 148/11.5 |
| 4,579,602 | 4/1986 | Paulonis et al. | 148/11.5 |

*Primary Examiner*—R. Dean

[57] ABSTRACT

A process is described for converting a fine grain superalloy casting into a forging having mechanical properties equivalent to those resulting from powder metallurgy processing. Cast material is extruded and forged. A HIP treatment is employed to close porosity.

39 Claims, 6 Drawing Sheets

2°F/HOUR

500X

5°F/HOUR

500X

10°F/HOUR

500X

200 X

500 X

100 X

100 X

100 X

100 X

NICKEL BASE SUPERALLOY ARTICLES AND METHOD FOR MAKING

TECHNICAL FIELD

This invention relates to the preparation of gamma prime strengthened nickel base superalloy forging preforms and the forging of such preforms, starting with cast material.

BACKGROUND ART

Nickel base superalloys are widely used in gas turbine engines. One application is for turbine disks. The property requirements for disk materials have increased with the general progression in engine performance. Early engines used easily forged steel and steel derivative alloys for disk materials. These were soon supplanted by the first generation nickel base superalloys such as Waspaloy which were capable of being forged, albeit often with some difficulty.

Nickel base superalloys derive much of their strength from the gamma prime phase. The trend in nickel base superalloy development has been towards increasing the gamma prime volume fraction for increased strength. The Waspaloy alloy used in the early engine disks contains about 25% by volume of the gamma prime phase whereas more recently developed disk alloys contain about 40–70% of this phase. The increase in the volume fraction of gamma prime phase reduces the forgeability. Waspaloy material can be forged from cast ingot starting stock but the later developed stronger disk materials cannot be reliably forged and require the use of more expensive powder metallurgy techniques to produce a disk preform which can be forged and then economically machined to final dimensions. One such powder metallurgy process which has met with substantial success for the production of engine disks is that described in U.S. Pat. Nos. 3,529,503 and 4,081,295. This process has proved highly successful with powder metallurgy starting materials but less successful with cast starting materials.

Other patents relating to the forging of disk material include U.S. Pat. Nos. 3,802,938; 3,975,219; 4,110,131, 4,574,015 and 4,579,602. This invention is in some respects an extension of the process of U.S. Pat. No. 4,574,015 patent which is incorporated herein by reference.

In summary therefore, the trend towards high strength disk materials has resulted in processing difficulties which have been resolved only through recourse to expensive powder metallurgy techniques.

It is an object of the present invention to describe a method through which cast high strength superalloy materials may be readily forged.

Another object of the present invention is to provide a method for producing forging preforms from cast superalloy materials which contain in excess of about 40% by volume of the gamma prime phase and which would otherwise be unforgeable.

A further object is to disclose a combined heat treatment, extrusion and forging process which will produce superalloy articles with void free fully recrystallized microstructures having a uniform fine grain size.

It is yet another object of the invention to provide a highly forgeable nickel base superalloy preform having an overaged gamma prime morphology with an average gamma prime size in excess of about 2 microns and a fully recrystallized microstructure.

DISCLOSURE OF INVENTION

Nickel base superalloys derive much of their strength from a distribution of gamma prime particles in a gamma matrix. The gamma prime phase is based on the compound $Ni_3Al$ where various alloying elements such as Ti and Cb may partially substitute for Al. Refractory elements such as Mo, W, Ta and Cb strengthen the gamma matrix phase and additions of Cr and Co are usually present along with the minor elements such as C, B and Zr.

Table I presents nominal compositions for a variety of superalloys which are formed by hot working. Waspaloy can be conventionally forged from cast stock. The remaining alloys are usually formed from powder, either by direct HIP (hot isostatic pressing) consolidation or by forging of consolidated powder preforms; forging of cast preforms of these compositions is usually impractical because of the high gamma prime content, although Astroloy is sometimes forged without resort to powder techniques.

A composition range which encompasses the alloys of Table I, as well as other alloys which appear to be processable by the present invention, is (in weight percent) 5–25% Co, 8–20% Cr, 1–6% Al, 1–5% Ti, 0–6% Mo, 0–7% W, 0–5% Ta, 0–5% Re, 0–2% Hf, 0–2% V, 0–5 Cb, balance essentially Ni along with the minor elements C, B and Zr in the usual amounts. The sum of the Al and Ti contents will usually be 4–10% and the sum of Mo+W+Ta+Cb will usually be 2.5–12%. The invention is broadly applicable to nickel base superalloys having gamma prime contents ranging up to about 75% by volume but is particularly useful in connection with alloys which contain more than 40% and preferably more than 50% by volume of the gamma prime phase and are therefore otherwise unforgeable by conventional (nonpowder metallurgical) techniques.

In a cast nickel base superalloy the gamma prime phase occurs in two forms: eutectic and noneutectic. Eutectic gamma prime forms during solidification while noneutectic gamma prime forms by precipitation during cooling after solidification. Eutectic gamma prime material is found mainly at grain boundaries and has particle sizes which are generally large, up to perhaps 100 microns. The noneutectic gamma prime phase which provides most of the strengthening in the alloy is found within the grains and has a typical size of 0.3–0.5 micron.

The gamma prime phase can be dissolved or taken into solution by heating the material to an elevated temperature. The temperature at which a phase goes into solution is its solvus temperature. The solutioning upon heating (or precipitation upon cooling) of the noneutectic gamma prime occurs over a temperature range. In this disclosure, the term solvus start will be used to describe the temperature at which observable solutioning starts (defined as an optical metallographic determination of the temperature at which about 5% by volume of the gamma prime phase, present upon slow cooling to room temperature, has been taken into solution) and the term solvus finish refers to the temperature at which solutioning is essentially complete (again determined by optical metallography). Reference to the gamma prime solvus temperature without the adjective start/finish will be understood to mean the solvus finish temperature.

The eutectic and noneutectic types of gamma prime form in different fashions and have different compositions and solvus temperatures. The noneutectic start and finish gamma prime solvus temperatures will typically be on the order of 50°–150° F. less than the eutectic gamma prime solvus temperatures. In the MERL 76 composition the noneutectic gamma prime solvus start temperature is about 2050° F. and the solvus finish temperature is about 2185° F. The eutectic gamma prime solvus start temperature is about 2170° F. and the gamma prime solvus finish temperature is about 2225° F. (since the incipient melting temperature is about 2185° F., the eutectic gamma prime cannot be fully solutioned without partial melting).

In its broadest form the present invention comprises extruding the material to form a fine, fully recrystallized structure, forging the recrystallized material to a desired shape, and then hot isostatically pressing the hot worked material. Usually the material will be given an overage heat treatment prior to extrusion.

The present invention process may be placed in perspective through consideration of FIG. 1 which is a flowchart showing the steps of the invention process including an alternative processing sequence. According to the FIG. 1 flowchart the starting material is a fine grain cast ingot which may be given an optional preliminary HIP treatment to close porosity and provide some homogenization or a preliminary heat treatment for homogenization. The material is then given an overage heat treatment process (preferably according to U.S. Pat. No. 4,574,015) in order to produce coarse gamma prime particle size. The heat treated ingot is then hot extruded after having preferably been first enclosed in a sheath or can for purposes of minimizing surface cracking. In the preferred invention process the material is then hot isostatically pressed to produce a forging preform which may then be forged to final shape. In an alternative processing sequence the extruded material is forged prior to being HIPped. In the discussion that follows the details of the various process steps will be presented.

Other features and advantages will be apparent from the specification and claims and from the accompanying drawings which illustrate an embodiment of the invention.

BEST MODE FOR CARRYING OUT THE INVENTION

Figure 1:
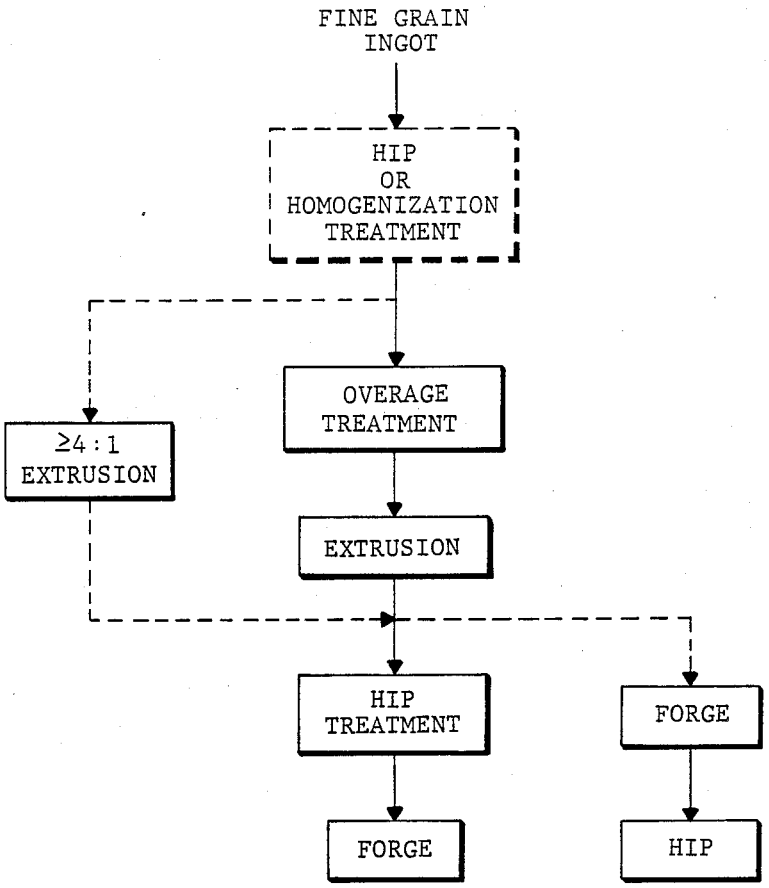
FIG. 1 is a flowchart illustrating the invention process steps.

The starting material (of a composition as previously described) must be fine grained, particularly in its surface regions. Various processes exist for producing fine grained castings, U.S. Pat. No. 4,261,412 is one such process and is incorporated herein by reference. All cracking encountered during development of the invention process has originated at the surface and was associated with large surface grains. We prefer to enclose the starting casting in a mild steel container or can ($\frac{3}{8}$ inch thick is typical) to reduce friction related surface cracking during extrusion, other canning variations are possible.

We have successfully extruded material having surface grain sizes on the order of 1/16 inch to $\frac{1}{4}$ inch diameter (grain sizes on the small end of this range are desired for the higher gamma prime fraction alloys) with only minor surface cracking. Extrusion is a beneficial process since it essentially places the work piece in a state of compression during deformation.

We believe that the interior grain size, the grain size more than about one-half inch below the surface of the casting can be coarser than the surface grains. The limiting interior grain size may well be related to the chemical inhomogeneities and segregation which occur in extremely coarse grain castings.

Equally important is the retention of grain size during the extrusion and forging processes. Processing conditions which lead to substantial grain growth are not desirable since increased grain size is associated with diminished hot deformability.

The as cast starting material may be given a HIP (hot isostatic pressing) prior to extrusion but this is optional and not generally needed in view of the HIP operation performed later in the process. Another option is a preliminary thermal treatment for homogenization.

The mechanical properties of precipitation strengthened materials, such as nickel base superalloys, vary as a function of gamma prime precipitate size. Peak mechanical properties are obtained with gamma prime sizes on the order of 0.1–0.5 microns. Aging under conditions which produce particle sizes in excess of that which provides peak properties produce what are referred to as overaged structures. An overaged structure is defined as one in which the average noneutectic gamma prime size is at least two times (and preferably at least five times) as large in diameter as the gamma prime size which produces peak properties. These are relative sizes, in terms of absolute numbers we require at least 1.5 microns and prefer at least 4 microns average diameter gamma prime particle sizes. Because extrudability is the objective, the gamma prime sizes referred to are those which exist at the extrusion temperature.

According to a preferred form of the invention the cast starting material is heated to a temperature between the noneutectic gamma prime start and finish temperatures (within the noneutectic solvus range). At this temperature a portion of the noneutectic gamma prime will go into solution. We prefer to dissolve at least 40% and preferably at least 60% of the noneutectic gamma prime material.

By using a very slow cooling rate the noneutectic gamma prime will reprecipitate in a coarse form, with the particle sizes on the order of 2 or even as great as 10 microns. This coarse gamma prime particle size substantially improves the extrudability of the material. The slow cooling step starts at a heat treatment temperature between the two solvus temperatures and finishes at a temperature near and preferably below the noneutectic gamma prime solvus start at a rate of less than 20° F. per hour.

Figure 2:
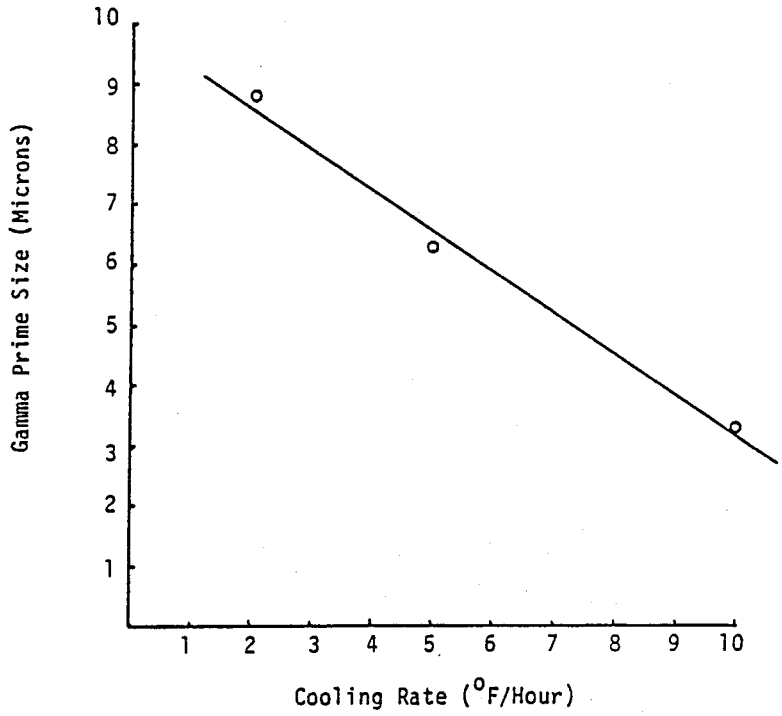
FIG. 2 shows the relationship between cooling rate and gamma prime particle size.
Figure 3A:
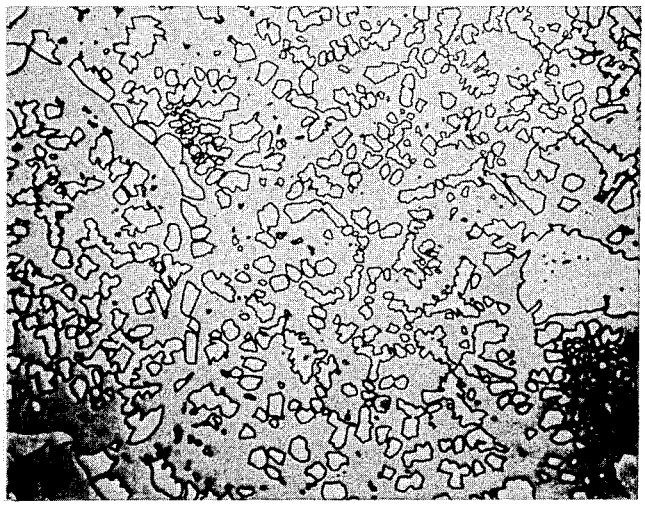
FIG. 3A, 3B, 3C are photomicrographs of material cooled at different rates.
Figure 3B:
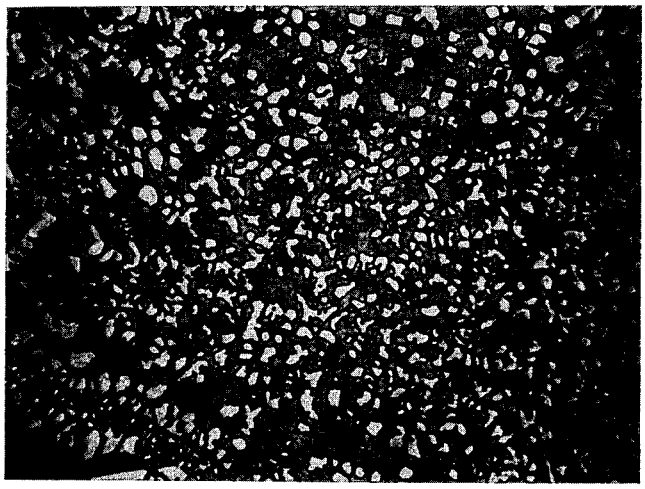
Figure 3C:
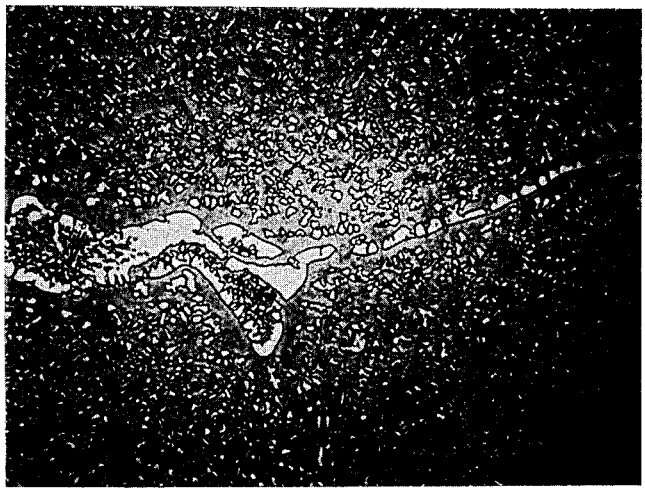

FIG. 2 illustrates the relationship between the cooling rate and the gamma prime particle size for the RCM 82 alloy described in Table I. It can be seen that the slower the cooling the larger the gamma prime particle size. A similar relationship will exist for the other superalloys but with variations in the slope and position of the curve. FIGS. 3A, 3B and 3C illustrate the microstructure of RCM 82 alloy which has been cooled at 2° F., 5° F. and 10° F. per hour from a temperature between the eutectic gamma prime solvus and the noneutectic gamma prime solvus (2200° F.) to a temperature (1900° F.) below the gamma prime solvus start. The difference in gamma prime particle size is apparent.

The cooling rate should be less than about 15° F. and preferably less than about 10° F. per hour. This relaxation of conditions from those taught in U.S. Pat. No. 4,574,015 is possible because extrusion reduces the likelihood of cracking thereby allowing use of lesser gamma prime sizes.

It is possible that in certain circumstances, where high extrusion reduction ratios are to be used (especially on alloys containing lesser amounts of gamma prime particles, e.g. less than 60%), that the overage heat treatment maybe omitted. The penalties for such omission would include cracking (reduced yield), reduced cross-section area, and imperfect recrystallization. Another alternative in high reduction (greater than about 4:1) cases would be an isothermal overage treatment performed at a temperature very near, but below the gamma prime solvus start temperature for an extended period of time to produce an overaged gamma prime microstructure.

It is highly desired that the grain size not increase during the previously described overage heat treatment. One method for preventing grain growth is to process the material below temperatures where all of the gamma prime phase is taken into solution. By maintaining a small but significant (e.g. 5–30% by volume) amount of gamma prime phase out of solution grain growth will be retarded. This will normally be achieved by exploiting the differences in solvus temperature beween the eutectic and noneutectic gamma prime forms (i.e. by not exceeding the eutectic gamma prime finish temperature), other methods of grain size control are discussed in U.S. Pat. No. 4,574,015.

A particular benefit of the invention process is that a uniform fine grain recrystallized microstructure will result from a relatively low amount of deformation of such a super overaged structure. In the case of extrusion, the invention process produces such a microstructure with about a 2.5:1 reduction in area; with conventional starting structures at least about a 4:1 reduction in area is required. This is significant in the practical production of forging preforms since current fine grained casting technology can produce only limited diameter casting; to go from a limited size starting size to a useful final size (after extrusion) clearly requires a minimum extrusion reduction. The desired recrystallized grain size is ASTM 8–10 or finer and will usually be ASTM 11–13.

The extrusion operation will be conducted using heated dies. The extrusion preheat temperature will usually be near (for example, within 50° F.) of the noneutectic gamma prime solvus start temperature.

The required extrusion conditions will vary with alloy, die geometry and extrusion equipment capabilities and the skilled artisan will be readily able to select the required conditions. So called stream line die geometry has been used with good results.

The extrusion step conditions the alloy for subsequent forging by inducing recrystallization in the alloy and producing an extremely fine uniform grain size. According to U.S. Pat. Nos. 3,519,503 and 4,081,295 the next step would be to forge the material to a final configuration using heated dies at a slow strain rate. However, we have found that voids associated with eutectic gamma prime particles, originate during the extrusion step. Apparently these large coarse hard particles impede uniform metal flow and become debonded from the surrounded metal matrix thus opening up voids. We have found that the subsequent forging step is insufficient to completely heal these voids so that they subsequently reduce mechanical properties. Consequently we require that a HIP step in the process sequence to provide final material having optimim fatique properties. The HIP step may be performed before or after the forging operation. The HIP step must be performed at a temperature low enough so that significant grain growth does not occur and at gas pressures that are high enough to produce metal flow sufficient to heal the voids. Typical conditions are about 50°–100° F. below the gamma prime solvus temperature at 15 ksi for 4 hours.

The material is then forged in compression using heated dies as taught as the last step in the process described in U.S. Pat. Nos. 3,519,503 and 4,081,296.

Figure 4:
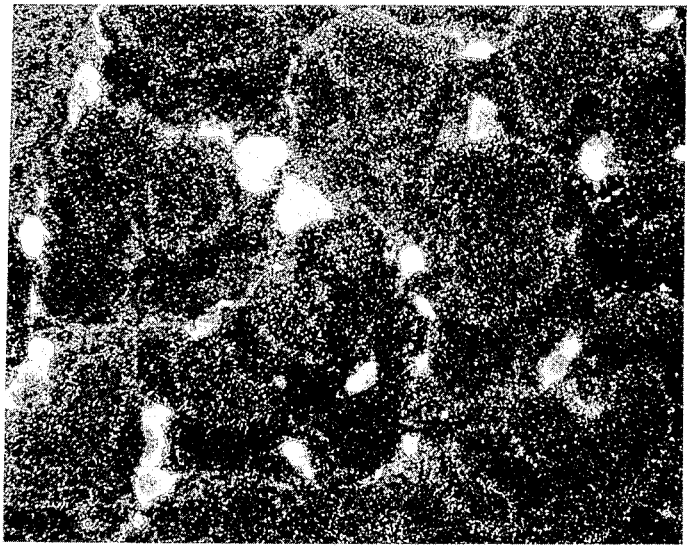
FIG. 4 is a photomicrograph of as cast material.
Figure 5A:
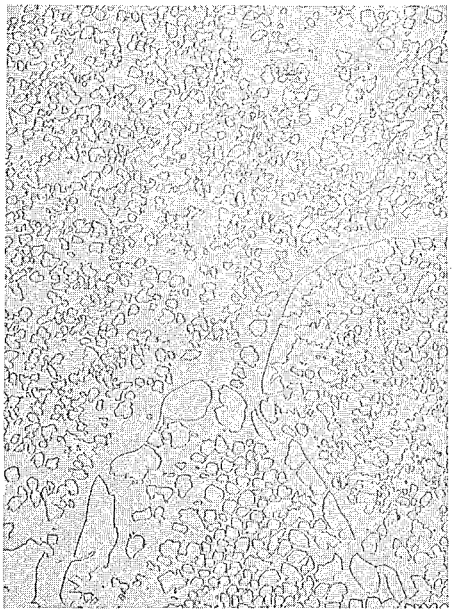
FIGS. 5A and 5B, 5C are photomicrographs of invention and prior art material before and after extrusion.
Figure 5B:
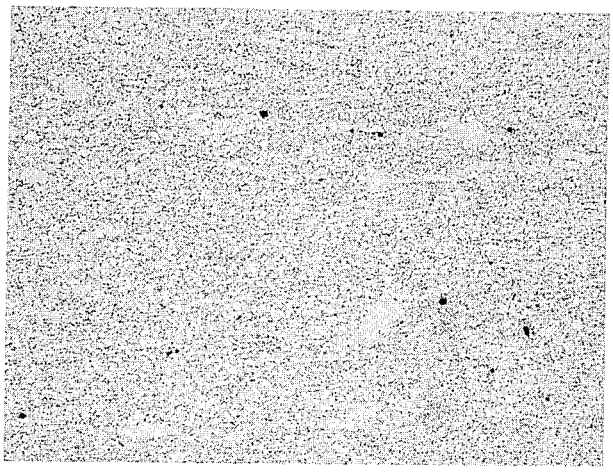

Certain microstructural features are illustrated in FIGS. 4, 5A and 5B. FIG. 4 illustrates the microstructure of cast material. This material has not been given the invention heat treatment. Visible in FIG. 4 are grain boundaries which contain large amounts of eutectic gamma prime material. In the center of the grains can be seen fine gamma prime particles whose size is less than about 0.5 micron.

Figure 5C:
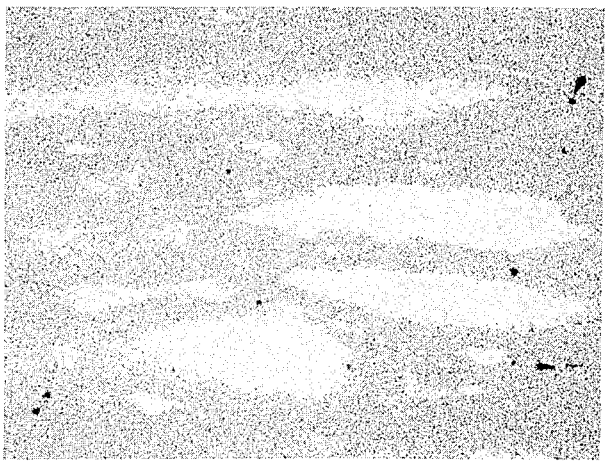

FIG. 5A shows the same alloy composition after the heat treatment of the present invention but prior to extrusion. The original grain boundaries are seen to contain areas of eutectic gamma prime. Significantly, the interior of the grains contain gamma prime particles which are much larger than the corresponding particles in FIG. 6. In FIG. 5A the gamma prime particles have a size of about 8.5 microns. After extrusion (2.5:1 reduction in area) the microstructure can be seen to be substantially recrystallized and uniform in FIG. 5B although remnants of the eutectic gamma prime material remain visible. FIG. 5C shows conventionally aged (2050° F. 4 hrs) material extruded at 4:1 showing large unrecrystallized areas.

Figure 6A:
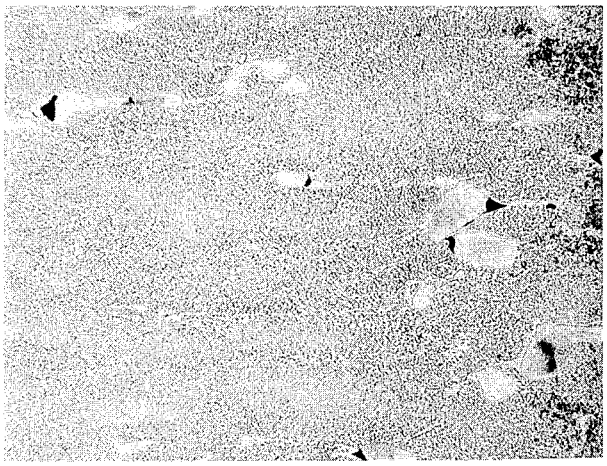
FIGS. 6A and 6B illustrate extrusion caused voids.
Figure 6B:
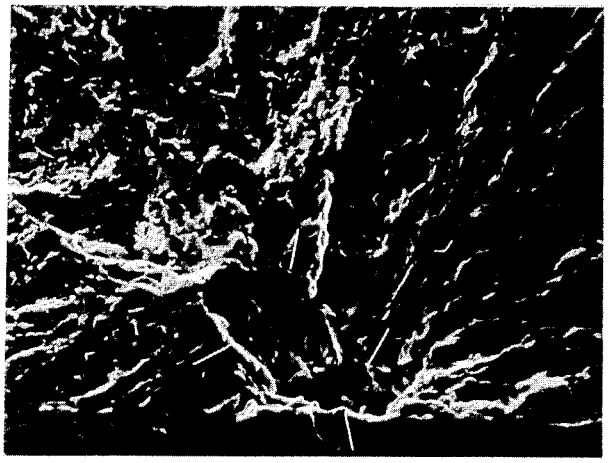

FIG. 6A shows the voids which are present in the material as extruded. FIG. 6B shows that one of these pores acted as the failure initiation site during low cycle fatique testing.

EXAMPLE

The processing of a composition identical to that described as MERL 76 in Table I (except that no hafnium was added) will be described.

The material as cast (apparently using the process described in U.S. Pat. No. 4,261,412) had a surface grain size of about ⅝ inch. The starting casting was HIPped at 2165° F. and 15 ksi for 4 hours. The material was then heat treated at 2170° F. for four hours and cooled to 1950° F. at 10° F. per hour and then was air cooled to room temperature to produce a 3 micron gamma prime size. Next the material was machined into a cylinder and placed in a mild steel can with a ⅜ inch wall. The canned material was preheated to 2050° F. prior to extrusion and was extruded at a 3½ to 1 reduction in area using a 45° geometry extrusion die which had been preheated to 700° F. Extrusion was preformed at 80 inches per minute. The material was then HIPped at 2075° F. 15 ksi applied gas pressure for 3 hours. Next the material was forged using heated dies.

Following forging mechanical properties were measured and the results are presented in Table II. It can be seen that the use of the HIP step provides substantially improved mechanical properties as compared with material which was not given the HIP step after extrusion. The mechanical properties of material given the invention process are essentially equivalent to those of prior art material processed using a substantially more expensive powder metallurgy process. Thus it can be seen that the present invention builds on the processes described in the U.S. Pat. Nos. 3,519,503; 4,081,295 and 4,574,015 and provides a low cost approach to producing high strength forged material starting from a fine grain casting.

It should be understood that the invention is not limited to the particular embodiments shown and described herein, but that various changes and modification may be made without departing from the spirit and scope of these novel concepts as defined by the following claims.

TABLE I

| | Waspaloy | Astroloy | RENE 95 | AF 115(2) | RCM 82(3) MERL 76 | IN 100(1) |
|---|---|---|---|---|---|---|
| Co | 13.5 | 17 | 8 | 15 | 18 | 18 |
| Cr | 19.5 | 15 | 13 | 10.7 | 12 | 12 |
| Al | 1.3 | 4 | 3.5 | 3.8 | 5.0 | 5.0 |
| Ti | 3.0 | 3.5 | 2.5 | 3.9 | 4.35 | 4.35 |
| Mo | 4.3 | 5.25 | 3.5 | 3.0 | 3.2 | 3.2 |
| W | — | — | 3.5 | 6.0 | — | — |
| Cb | — | — | 3.5 | 1.7 | 1.3 | — |
| C | .08 | .06 | .07 | .05 | .025 | .07 |
| B | .006 | .03 | .010 | .02 | .02 | .014 |
| Zr | .06 | — | .05 | .05 | .06 | .06 |
| Ni | Bal | Bal | Bal | Bal | Bal | Bal |
| %(4) | 25 | 40 | 50 | 55 | 65 | 65 |

(1)Also contains 1.0% V
(2)Also contains 0.75% Hf
(3)MERL 76 contains 0.4% Hf
(4)Volume percent

TABLE II

| WITH HIP | WITHOUT HIP |
|---|---|
| a. Fatigue tested at 155 ksi, 900° F., No failure at 100,000 cycles Then uploaded to 170 ksi - failed after 7,000 cycles.* | a. Fatigue tested at 155 ksi, 900° F., Failed after 30,000 cycles |

*When similarly tested, prior art powder processed material fails after 6–10,000 cycles.

We claim:

1. Method of providing a nickel base superalloy forging preform, including the steps of
   a. providing a fine grain cast ingot
   b. heat treating the ingot to produce an overaged noneutectic gamma prime microstructure
   c. extruding the heat treated ingot at a reduction in area sufficient to produce a completely recrystallized fine grain microstructure
   d. hot isostatic pressing the extruded material to close all voids and porosity at a temperature low enough to prevent significant grain growth whereby the resultant article will have a fine grain size, a coarse gamma prime size and will be suited for subsequent forging.

2. Method as in claim 1 wherein cast ingot consists of (by weight)
   5–25% Co
   8–20% Cr
   1–6% Al
   1–5% Ti
   0–6% Mo
   0–7% W
   0–5% Cb
   0–5% Ta
   0–5% Re
   0–2% Hf
   0–2% V
   0–0.5% C
   0–0.15% B
   0–0.15% Zr
   balance essentially Ni.

3. Method as in claim 1 in which the starting grain size (at the ingot surface) is no larger than about ⅛ inch.

4. Method as in claim 1 in which the heat treatment step includes cooling the material from a temperature at which at least 40% by volume of the noneutectic gamma prime phase is dissolved in the matrix to a temperature below the noneutectic gamma prime solvus start temperature at a rate of less than about 15° F./hr. to significantly coarsen the gamma prime particles.

5. Method as in claim 1 in which the material is canned prior to extrusion.

6. Method as in claim 1 in which the material is extruded with a reduction in area greater than about 2.5:1.

7. Method as in claim 1 which the recrystallized grain size is ASTM 8–10 or finer.

8. Method as in claim 1 in which the material is extruded with a reduction in area greater than about 3.5:1.

9. Method as in claim 1 in which the gamma prime particle size after the heat treatment exceeds about 1.5 microns.

10. Method as in claim 1 in which the gamma prime particle size after the heat treatment exceeds about 4 microns.

11. Method of producing a nickel base superalloy forging from a fine grain cast ingot which contains more than about 40% by volume of the gamma prime phase, including the steps of
   a. heat treating the ingot to produce an overaged noneutectic gamma prime particle microstructure
   b. extruding the heat treated ingot at a reduction in area sufficient to produce a completely recrystallized fine grain microstructure
   c. hot isostatic pressing the extruded material to close voids and porosity at a temperature low enough to prevent significant grain growth
   d. forging the material using heated die.

12. Method as in claim 11 wherein cast ingot consists of (by weight)
   5–25% Co
   8–20% Cr
   1–6% Al
   1–5% Ti
   0–6% Mo
   0–7% W
   0–5% Cb
   0–5% Ta
   0–5% Re
   0–2% Hf
   0–2% V
   0–0.5% C
   0–0.15% B
   0–0.15% Zr
   balance essentially Ni.

13. Method as in claim 11 in which the starting grain size (at the ingot surface) is no larger than about ⅛ inch.

14. Method as in claim 11 in which the heat treatment step includes cooling the material from a temperature at which at least 40% by volume of the noneutectic gamma prime phase is dissolved in the matrix to a temperature below the noneutectic gamma prime solvus start temperature at a rate of less than about 15° F./hr. to significantly coarsen the gamma prime particles.

15. Method as in claim 11 in which the material is canned prior to extrusion.

16. Method as in claim 11 in which the material is extruded with a reduction in area greater than about 2.5:1.

17. Method as in claim 11 which the recrystallized grain size is ASTM 8–10 or finer.

18. Method as in claim 11 in which the material is extruded with a reduction in area greater than about 3.5:1.

19. Method as in claim 11 in which the gamma prime particle size after the heat treatment exceeds about 4 microns.

20. Method as in claim 11 in which the gamma prime particle size after the heat treatment exceeds about 4 microns.

21. Method of producing a nickel base superalloy forging from a fine grain cast ingot which contains more than about 40% by volume of the gamma prime phase, including the steps of a. heat treating the ingot to produce an overage noneutectic gamma prime particle microstructure
b. extruding the heat treated ingot at a reduction in area sufficient to produce a completely recrystallized fine grain microstructure
c. forging the extruded material using heated dies.
d. hot isostatic pressing the forged material to close voids and porosity at a temperature low enough to prevent significant grain growth.

22. Method as in claim 21 wherein cast ingot consists of (by weight)

5–25% Co
8–20% Cr
1–6% Al
1–5% Ti
0–6% Mo
0–7% W
0–5% Cb
0–5% Ta
0–5% Re
0–2% Hf
0–2% V
0–0.5% C
0–0.15% B
0–0.15% Zr
balance essentially Ni.

23. Method as in claim 21 in which the starting grain size (at the ingot surface) is no larger than about ⅛ inch.

24. Method as in claim 21 in which the heat treatment step includes cooling the material from a temperature at which at least 40% by volume of the noneutectic gamma prime phase is dissolved in the matrix to a temperature below the noneutectic gamma prime solvus start temperature at a rate of less than about 15° F./hr. to significantly coarsen the gamma prime particles.

25. Method as in claim 21 in which the material is canned prior to extrusion.

26. Method as in claim 21 in which the material is extruded with a reduction in area greater than about 2.5:1.

27. Method as in claim 21 which the recrystallized grain size is ASTM 8–10 or finer.

28. Method as in claim 21 in which the material is extruded with a reduction in area greater than about 3.5:1.

29. Method as in claim 21 in which the gamma prime particle size after the heat treatment exceeds about 1.5 microns.

30. Method as in claim 21 in which the gamma prime particle size after the heat treatment exceeds about 4 microns.

31. Method of providing a nickel base superalloy forging preform, including the steps of a. providing a fine grain cast ingot
b. extruding the heat treated ingot at a reduction ratio in excess of about 4:1 to produce a completely recrystallized fine grain microstructure
c. hot isostatic pressing the extruded material to close all voids and porosity at a temperature low enough to prevent significant grain growth whereby the resultant article will have a fine grain size, a coarse gamma prime size and will be suited for subsequent forging.

32. Method as in claim 31 wherein cast ingot consists of (by weight)

5–25% Co
8–20% Cr
1–6% Al
1–5% Ti
0–6% Mo
0–7% W
0–5% Cb
0–5% Ta
0–5% Re
0–2% Hf
0–2% V
0–0.5% C
0–0.15% B
0–0.15% Zr
balance essentially Ni.

33. Method as in claim 31 in which the starting grain size (at the ingot surface) is no larger than about ⅛ inch.

34. Method of producing a nickel base superalloy forging from a fine grain cast ingot which contains more than about 40% by volume of the gamma prime phase, including the steps of a. extruding the heat treated ingot at a reduction ratio in excess of about 4:1 to produce a completely recrystallized fine grain microstructure
b. hot isostatic pressing the extruded material to close voids and porosity at a temperature low enough to prevent significant grain growth
c. forging the material using heated dies.

35. Method as in claim 34 wherein cast ingot consists of (by weight)

5–25% Co
8–20% Cr
1–6% Al
1–5% Ti
0–6% Mo
0–7% W
0–5% Cb
0–5% Ta
0–5% Re
b 0–2% Hf

0–2% V
0–0.5% C
0–0.15% B
0–0.15% Zr
balance essentially Ni.

36. Method as in claim 34 in which the starting grain size (at the ingot surface) is no larger than about ⅛ inch.

37. Method of producing a nickel base superalloy forging from a fine grain cast ingot which contains more than about 40% by volume of the gamma prime phase, including the steps of a. extruding the heat treated ingot at a reduction ratio greater than about 4:1 to produce a completely recrystallized fine grain microstructure
b. forging the extruded material using heated dies.
c. hot isostatic pressing the forged material to close voids and porosity at a temperature low enough to prevent significant grain growth.

38. Method as in claim 37 wherein cast ingot consists of (by weight)

5–25% Co
8–20% Cr
1–6% Al
1–5% Ti
0–6% Mo
0–7% W
0–5% Cb
0–5% Ta
0–5% Re
0–2% Hf
0–2% V
0–0.5% C
0–0.15% B
0–0.15% Zr
balance essentially Ni.

39. Method as in claim 37 in which the starting grain size (at the ingot surface) is no larger than about ⅛ inch.

* * * * *